US007283144B2

(12) United States Patent
Horiuchi et al.

(10) Patent No.: US 7,283,144 B2
(45) Date of Patent: Oct. 16, 2007

(54) HEAT DEVELOPING APPARATUS AND HEAT DEVELOPING METHOD

(75) Inventors: Makoto Horiuchi, Tokyo (JP); Akira Taguchi, Hachioji (JP)

(73) Assignee: Konica Minolta Medical & Graphic, Inc, Tokyo (JP)

( * ) Notice: Subject to any disclaimer, the term of this patent is extended or adjusted under 35 U.S.C. 154(b) by 247 days.

(21) Appl. No.: 11/129,864

(22) Filed: May 16, 2005

(65) Prior Publication Data

US 2005/0259987 A1 Nov. 24, 2005

(30) Foreign Application Priority Data

May 21, 2004 (JP) ..... 2004-151816

(51) Int. Cl.
*G03D 13/00* (2006.01)

(52) U.S. Cl. ..... 347/140; 430/350; 355/27

(58) Field of Classification Search ..... 347/140; 396/575; 355/27; 430/350
See application file for complete search history.

(56) References Cited

U.S. PATENT DOCUMENTS 6,137,563 A 10/2000 Agano
6,297,476 B1 10/2001 Kashino et al.
6,309,114 B1 * 10/2001 Torisawa et al. ..... 396/575
6,400,446 B1 6/2002 Kashino et al.
6,411,320 B1 * 6/2002 Mcdaniel et al. ..... 347/212

FOREIGN PATENT DOCUMENTS

| | | |
|---|---|---|
| EP | 0 915 395 A1 | 5/1999 |
| JP | 05-006043 | 1/1993 |
| JP | 05-053463 | 3/1993 |
| JP | 10-500497 | 1/1998 |
| JP | 11-065070 | 3/1999 |
| JP | 2002-244266 | 8/2002 |

* cited by examiner

*Primary Examiner*—Huan Tran
(74) *Attorney, Agent, or Firm*—Lucas & Mercanti, LLP

(57) ABSTRACT

This heat developing method includes a step of forming a latent image on a heat developing photosensitive film sheet and a step of developing the film sheet, while the film sheet on which a latent image is formed is being conveyed, by heating with segmented heaters which are formed by dividing the total heating area into plural segments in the direction perpendicular to the conveyance direction, and which are independently temperature controllable, wherein the film sheet is so conveyed that no film sheets of different sizes are simultaneously in contact with any segmented heater.

14 Claims, 8 Drawing Sheets

HEAT DEVELOPING APPARATUS AND HEAT DEVELOPING METHOD

This application is based on Japanese Patent Application No. 2004-151816 filed on May 21, 2004, in Japanese Patent Office, the entire content of which is hereby incorporated by reference.

BACKGROUND OF THE INVENTION

The present invention relates to a heat developing apparatus and a heat developing method for developing and visualizing a latent image which has been formed on a heat-developing photosensitive film sheet.

The following Patent Document 1 discloses a heat-developing photosensitive material recording device in which a film, being an exposed recording material, is conveyed into a heat-developing section and developed as it is in contact with a heating drum and thereby heated. In this case, since the size of film varies depending upon the photographed object (photographed portion), the type of film conveyed to the heat-developing section also varies from time to time. Since the film is developed as it passes through a heating unit, accordingly, if the heating unit employs a heating drum, for example, the temperature of the area that is utilized for development (the area that is actually in contact with the film, which is called the "developing area" below) becomes lower than in other areas because the film removes heat from that contact area.

If the same area on the heating drum surface is always utilized for development, the temperature of the developing area is almost stable even when a plurality of recording films are developed in series, and therefore stable development becomes possible. When the film size is changed, however, the position, dimensions and shape of the developing area are different from the previous development operation. Consequently, problems tend to arise in that the temperature distribution in the new developing area does not become uniform immediately after changing to a different film size, and uneven development is easily caused.

This problem is remarkably found particularly when the recording material is changed from a small size to a large size. Since high image quality is required in the medical field, high image-quality recording film is employed. But, because the effect of heat on high image-quality recording film like the above during development is very much, the above-mentioned uneven development tends to occur.

The following Patent Document 2 discloses an image forming apparatus in which, in order to prevent overheating of the sheet non-passage area on a fixing roller when recording material is continuously fed into the fixing unit, the feeding interval of the recording material is changed during the continuous feed between fixing at the first set temperature and fixing at the second set temperature. In a fixing unit like the above, however, temperature non-uniformity is caused on the fixing roller surface, because, although the surface temperature of the recording material passage area on the fixing roller becomes lower while the recording material passes through it, heat is hard to be removed from the recording material non-passage area of the fixing roller. This temperature non-uniformity is remarkably evident when the recording material continuously passes through the fixing roller surface. If the temperature is set high enough for the sheet passage area in this operation, the sheet non-passage area becomes excessively hot. This tendency is particularly marked when the set temperature of the fixing roller is changed, when the size of recording material is changed, and for a while after the fixing roller surface reaches the temperature for image forming.

The following Patent Document 3 discloses a heat-developing apparatus, using a heat-developing method that can control image-quality degradation due to the temperature drop of heating members resulting from continuous processing, and also continuously heat-develops the heat-developing sheets of different sizes on which an exposed latent image has been formed, to reduce the continuous process time, in which the minimum required temperature restoration time for heat-developing the following heat-developing sheet is determined from the physical data of the heat-developing sheet currently being developed, and the development of the following heat-developing sheet to be developed next is started after the minimum temperature restoration time has elapsed.

The heat-developing apparatus of Patent Document 3 employs the same method as for Patent Document 2, the temperature of which is controlled by a single sensor in the lateral direction and the apparatus carries out nothing but waiting until the temperature distribution in the lateral direction becomes uniform. Processing capacity cannot improve when the size of the recording material or heat-developing sheet is changed frequently.

The following Patent Document 4 discloses a fixing device provided on a copying machine, printer, facsimile machine, or the like. A fixing device of this type is equipped with a heating member, where the surface temperature of fixing roller is sensed by a thermal sensor and the surface temperature of the fixing roller is controlled via signals to maintain at a specified temperature by varying the heat from the heating member. That is to say, it is in an ON/OFF system, by which power to the heating member is turned ON if the surface temperature of the fixing roller is lower than the specified temperature and turned OFF if higher, or electrical power to the heating member is controlled accordingly. This temperature control is achieved using signals from a thermal sensor such as thermistor installed in contact with or close to the fixing roller surface, where the surface temperature of the fixing roller is sensed at one location.

However, it frequently happens that the surface temperature of the fixing roller is not at a constant temperature particularly across its whole width in the axial direction resulting from airflow inside or outside the apparatus, operating conditions, sheet size, or inherent differences among machines. Consequently, the surface temperature of the fixing roller near the portion where the thermal sensor is installed is controlled to the specified temperature but the specified temperature may not be maintained at portions away from the thermal sensor. Under this condition, problems arise in that fixing characteristics do not become uniform so that stable and favorable fixing cannot be achieved.

In Patent Document 4, in order to maintain nearly constant temperature across the whole width of the fixing roller in the fixing device, even when the temperature condition of the fixing roller is different in the axial direction, the fixing roller is divided into two heating areas, nearly equally divided into right and left portions in the axial direction. A high-temperature heating member of each heater is provided across the whole heating area, a thermal sensor for sensing the surface temperature of each heating area is provided, and temperature balance on the fixing roller surface is controlled so that each heating area is maintained at the specified temperature.

The following Patent Document 5 discloses an apparatus in which a film sheet is subjected to heating and conveyed while it is wound around a heating drum and pressed by opposed rollers. This apparatus is capable of processing three different sized sheets of film of 14×17 inch, 14×14 inch and 11×14 inch having the same width, by the same heater pattern. When processing of 10×12 inch or 8×10 inch is also desired, however, the apparatus requires a stand-by time until the drum is restored to a uniform temperature due to the changed size. This stand-by time can become much longer when the size is changed after continuous processing of film sheets of the same size because the temperature difference between the film-passage portion and non-passage portion becomes much greater. The stand-by time also varies depending upon the type of film and temperature setting for heat-development. Accordingly, the processing capacity per unit time is tremendously low.

[Patent Document 1] Tokkai Hei No. 11-65070
[Patent Document 2] Tokkai Hei No. 05-6043
[Patent Document 3] Tokkai No. 2002-244266
[Patent Document 4] Tokkai Hei No. 05-53463
[Patent Document 5] Tokuhyou Hei No. 10-500497

SUMMARY OF THE INVENTION

In view of the above problems in the prior art, an object of the present invention is to offer a heat-developing apparatus and heat-developing method that can supply a specific quantity of heat to the heat-developing photosensitive material, which is conveyed while being heated, and to maintain stable finished image density by using a heating method in which heating area is divided into multiple heater patterns corresponding to film passage phases.

In order to achieve the above object, the heat-developing apparatus of the present invention is composed of a film loading means on which heat-developing photosensitive film sheets of different sizes can be loaded, a conveying means for conveying the heat-developing photosensitive film sheets from the film loading means, an exposing means for forming a latent image on the conveyed heat-developing photosensitive film, a heat-developing means for developing and visualizing a heat-developing photosensitive film on which a latent image has been formed, including a heating means for heating the heat-developing photosensitive film sheet, and an auxiliary means for heating and conveying the heat-developing photosensitive film sheet while pressing the film against the heating means. It also is composed of a controlling means for controlling the conveying means, the exposing means and the heat-developing means. The heating means is composed of a heater that is divided into at least multiple areas, in the direction perpendicular to the conveying direction of the heat-developing photosensitive film sheets, each of which is capable of independently controlling the temperature. Further a control means controls the conveyance of the heat-developing photosensitive film sheet so that heat-developing photosensitive film sheets of different sizes can not simultaneously be in contact with any of the multiple segmented heater sections.

With this heat-developing apparatus, the temperature distribution across the width direction can be controlled to become uniform by independently controlling the multiple segmented heaters, corresponding to the film passage phase. When a heat-developing photosensitive film sheet of some size is heated by a set of segmented heaters and then a different sized heat-developing photosensitive film sheet is conveyed, the conveyance of that film sheet is so controlled that the foregoing and following heat-developing photosensitive sheets of film can not simultaneously be in contact with each segmented heater section, and hence a different sized heat-developing film sheet can be conveyed and heated after the temperature of each heater section has become suitable for that size of heat-developing photosensitive film sheet. Accordingly, even when the size of a sheet of heat-developing photosensitive film is changed, a specific quantity of heat can always be supplied to a specific sized sheet of the heat-developing photosensitive film and thus stable finished image density can be maintained.

In the above heat-developing apparatus, the heating means is not practically divided in the conveyance direction and, when different sized heat-developing photosensitive film sheets are conveyed, the control means stops conveying the following different sized film sheet to the heating means until the trailing edge of the foregoing film sheet being another size has been detached from the heating means, and hence the following different sized heat-developing photosensitive film sheet can be conveyed and heated after the temperature of each segmented heater section has been suitably controlled for the following heat-developing photosensitive film sheet.

In the above apparatus, the heat developing means can be so constructed to comprise a heating drum that is equipped with a sheet heater on the interior of its sleeve and driven to rotate and opposed rollers which are installed around the circumference of the heating drum.

By constructing the apparatus so that the heater of the heating means is divided into multiple segments, also in the conveyance direction, the temperature of each of which is capable of being independently controlled, and that, when different sized heat-developing photosensitive film sheets are conveyed, the control means controls the conveyance of the heat-developing photosensitive film so that the foregoing and following heat-developing photosensitive sheets of film can not simultaneously be in contact with any segmented heater section in the conveyance direction, the following different sized heat-developing photosensitive film sheet can be conveyed and heated after the temperature of each segmented heater has been suitably controlled for the following sheet of heat-developing photosensitive film.

In the above case, the heating means divided into multiple segments can be constructed as fixed plate heaters and the auxiliary means can be constructed as opposed rollers installed opposite to the plate heaters.

The heat-developing method according to the present invention includes a step of forming a latent image on a conveyed sheet of heat-developing photosensitive film and a step of heating and developing the sheet of heat-developing photosensitive film with a latent image formed thereon while conveying it, by a heater which is divided into multiple segments, in the direction perpendicular to the conveyance direction, each segment of which is capable of independently controlling the temperature, wherein the sheets of heat-developing photosensitive film are so conveyed that different sized heat-developing photosensitive film sheets can not simultaneously be in contact with any of the multiple segmented heaters.

With this heat-developing method, the temperature distribution across the width direction can be controlled to become uniform by independently controlling the multiple segmented heaters corresponding to film passage phase. When a sheet of heat-developing photosensitive film of some size is heated by segmented heaters and then a different sized heat-developing photosensitive film sheet is conveyed to the heater section, the conveyance of the sheet of film is so controlled that the foregoing and following sheet of heat-developing photosensitive film can not simultaneously be in contact with any segmented heater, and hence the following different sized sheet of heat-developing film can be conveyed and heated after the temperature of each heater section has been suitably controlled. Accordingly, even when the sheet size of heat-developing photosensitive film is changed, a specific quantity of heat can always be supplied to the heat-developing photosensitive film and stable finished image density can be maintained.

In the above heat-developing method, when different sized sheet of heat-developing photosensitive film are conveyed, conveyance of a different sized sheet of following film into the heating means is temporary stopped until the trailing edge of another sized sheet of foregoing film has been detached from the heating means, and hence the different sized sheet of following heat-developing photosensitive film can be conveyed and heated after the temperature of each segmented heater has been suitably controlled.

In the above heat-developing apparatus and heat-developing method, when the upstream heat-developing photosensitive film is controlled to stand by, due to a change of the film size, this stand-by time T can theoretically be constantly defined by the following equation in which the heater section length is L and the conveyance velocity is V, irrespective of the heat-developing time setting, type of film sheet, whether or not there has been a change of the film sheet size after continuous processing and heating size pattern to be changed to.

$$T=L/V$$

According to the heat-developing apparatus and heat-developing method of the present invention, a specific quantity of heat can be always supplied to the heat-developing photosensitive material, which is conveyed while being heated, and stable finished image density can be maintained by using a heating method where the heating area is divided into multiple heater patterns corresponding to film sheet passage phases through a heating means.

DETAILED DESCRIPTION OF THE PREFERRED EMBODIMENT

Preferred embodiments for realizing the present invention are described below, using figures.

The First Embodiment

Figure 1:
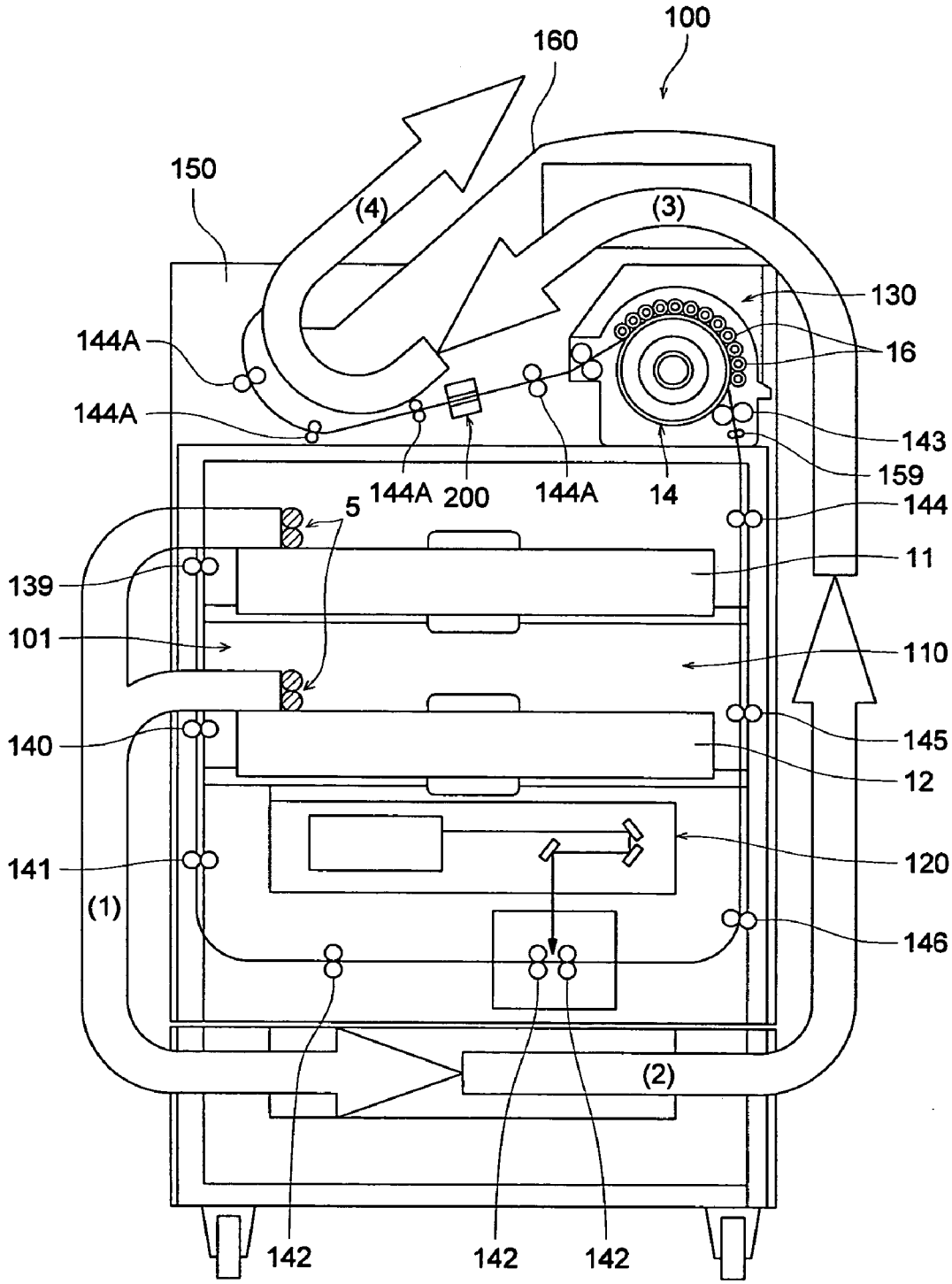
FIG. 1 is a frontal view of the main parts of the heat developing apparatus of the first embodiment.
Figure 2:
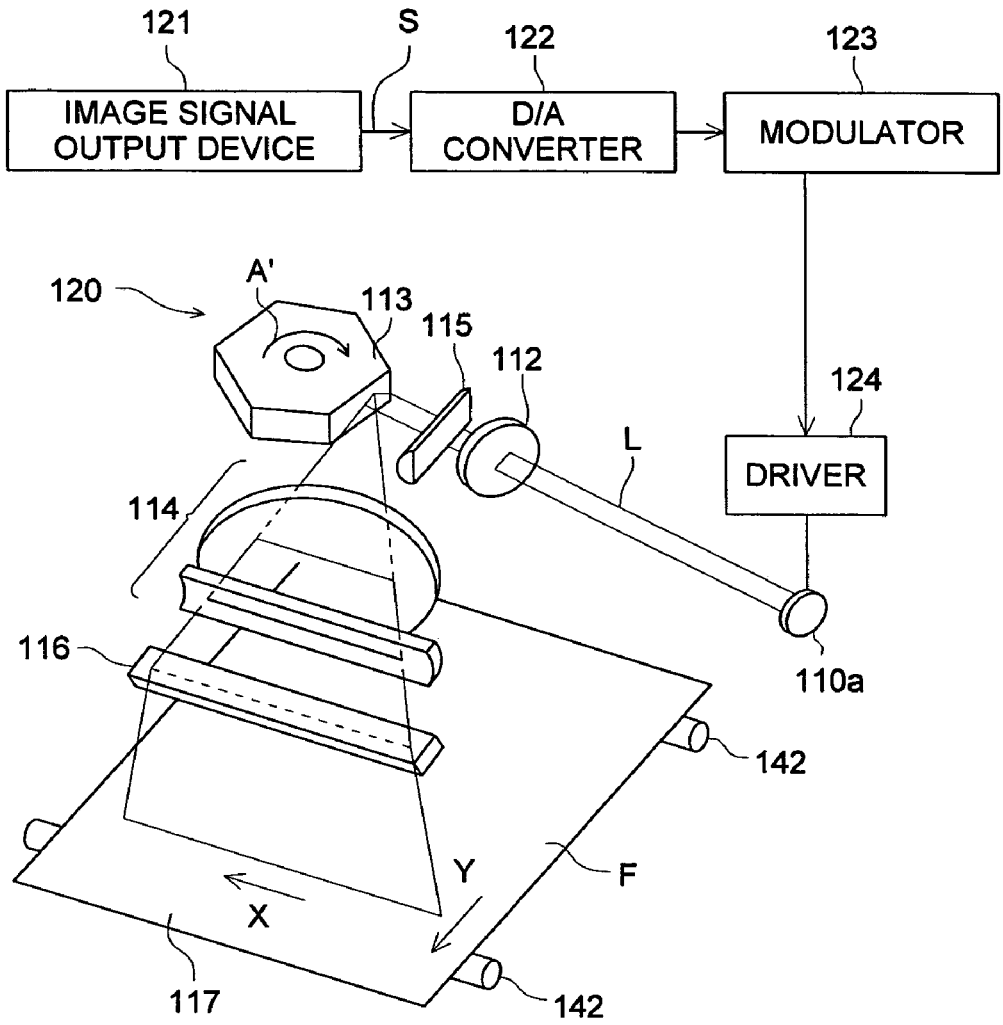
FIG. 2 is a schematic diagram of the exposure section of the heat developing apparatus in FIG. 1.

FIG. 1 is a front view showing major portions of the heat-developing apparatus according to the first embodiment. FIG. 2 is a schematic figure showing the exposure section of the heat-developing apparatus in FIG. 1.

As shown in FIG. 1, heat-developing apparatus 100 is composed of supply section 110 incorporating first and second loading sections 11 and 12 for loading a package containing a specified number of sheets of heat-developing photosensitive material, i.e. heat-developing photosensitive film (hereinafter, sometimes simply called "film") and conveying section 5 for conveying successive sheets of film one after another for exposure and development, exposure section 120 which exposes the film supplied from supply section 110 and which forms a latent image on the film, heat-developing section 130 for heat-developing the film with a latent image formed thereon, and cooling and conveying section 150 including densitometer 200 for measuring the image density of the developed film and also for obtaining image density information, and sets of conveying rollers 144A.

Different sized film sheets are loaded each into first and second loading sections 11 and 12 of supply section 110, from which the film sheets are sequentially conveyed either from first loading section 11 or second loading section 12 in arrowed direction (1) in FIG. 1 by conveying section 5 and paired conveying rollers 139, 140 and 141, which convey individual sheet of film downward to exposure section 120.

Next, the film is conveyed horizontally in arrowed direction (2) and, while sub-scanning conveyance of the sheet of film is conducted by paired conveying rollers 142, a laser beam is irradiated onto it by exposure section 120 and a latent image is formed on the film.

The film is next conveyed in arrowed direction (3) by paired sets of conveying rollers 146, 145, 144 and 143, which convey the film sheet carrying a latent image formed thereon upward to heat-developing section 130.

Figure 5:
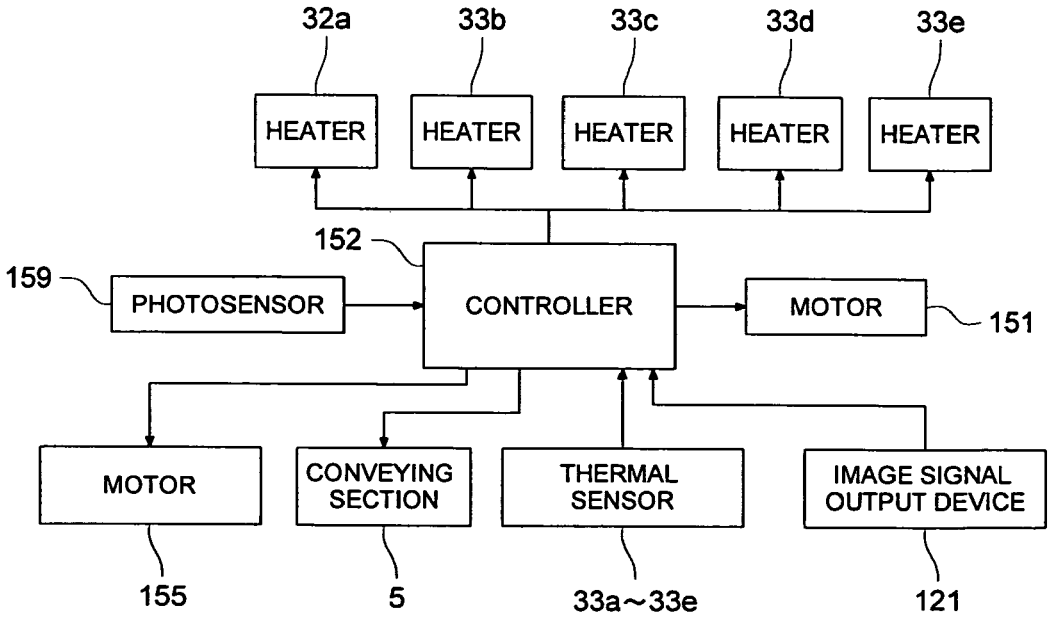
FIG. 5 is a block diagram showing the control systems of the heat developing apparatus in FIG. 1.

Then, the latent image on the film is visualized in the heat-developing section 130, conveyed further in arrowed direction (4) by paired sets of conveying rollers 144A, and then passes through cooling and conveying section 150, after which it is discharged into discharge section 160. Paired conveying rollers 139, 141, 142, 146, 145, 144 and 143 are driven to rotate by motor 151 (FIG. 5).

The exposure section will now be described. As shown in FIG. 2, exposure section 120 employs laser beam L to form a latent image on film sheet F, wherein laser beam L the intensity of which has been modulated based on image signals S is deflected through rotating polygonal mirror 113 so as to carry out main-scanning on film sheet F, and also film sheet F is moved relative to laser beam L in a direction substantially perpendicular to the main scanning direction so that sub-scanning is also conducted on film sheet F.

The detailed structure of exposure section 120 is described hereunder. In FIG. 2, image data outputted from external image signal output device 121 is received via the Internet and image signals S, i.e. digital signals of the image data are converted into analog signals by D/A converter 122 and then inputted to modulator 123. Modulator 123 controls driver 124 of laser light source 110*a* based on the above analog signals so that the modulated irradiating laser beam L is emitted from laser light source 110*a*.

Laser beam L irradiated from laser light source 110*a* is transmitted through lens 112 and then, after being converged only in the vertical direction through cylindrical lens 115, enters rotating polygonal mirror 113, rotating in arrowed direction A' in FIG. 2, as a line image perpendicular to the drive axis of the mirror. Rotating polygonal mirror 113 reflects and deflects laser beam L in the main scanning direction, and deflected laser beam L passes through fθ lens 114, including a cylindrical lens composed of two combined lenses. Then the beam is reflected by mirror 116 located according to the main scanning direction in the light path so as to carry out main-scanning repeatedly in arrowed direction X on scanning surface 117 of film sheet F, which is being conveyed (sub-scanned) in arrowed direction Y by paired conveying rollers 142. In short, entire scanning surface 117 of film sheet F is scanned by laser beam L.

The cylindrical lens of fθ lens 114 is designed to converge incident laser beam L on scanning surface 117 of film sheet F only in the sub-scanning direction, and the distance from fθ lens 114 to the scanning surface is equal to the focal length of the whole fθ lens 114. Since exposure section 120 is provided with fθ lens 114, including the cylindrical lens, and mirror 116, and laser beam L is once converged only in the sub-scanning direction by rotating polygonal mirror 113 as explained above, the scanning position of laser beam L will not shift in the sub-scanning direction but equally pitched scanning lines can be formed on scanning surface 117 of film sheet F even if inclination of the face or an axial offset is caused on rotating polygonal mirror 113. Compared to a galvanometer mirror or other optical polarizers, rotating polygonal mirror 113 has the advantage of excellent scanning stability. Accordingly, a latent image is formed on film sheet F based on image signals S.

Figure 3:
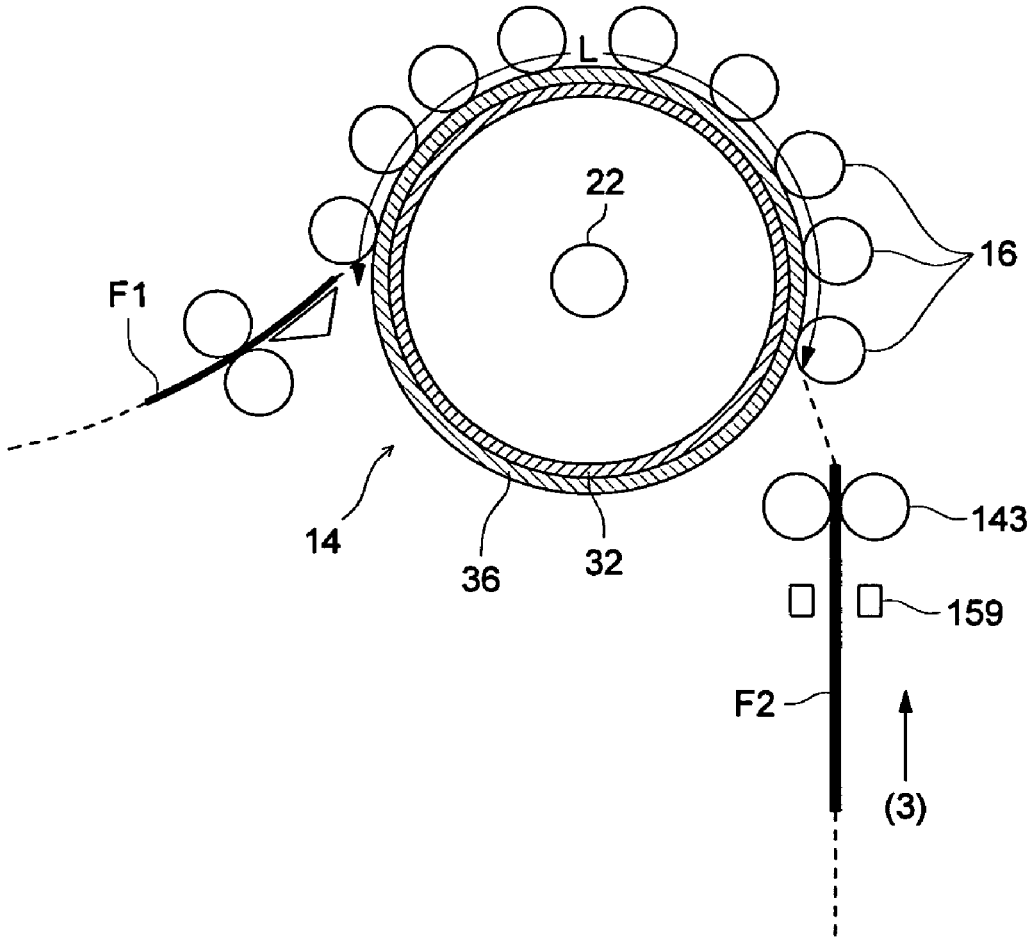
FIG. 3 is a schematic frontal view of main parts of heat developing section 130 in FIG. 1.
Figure 4:
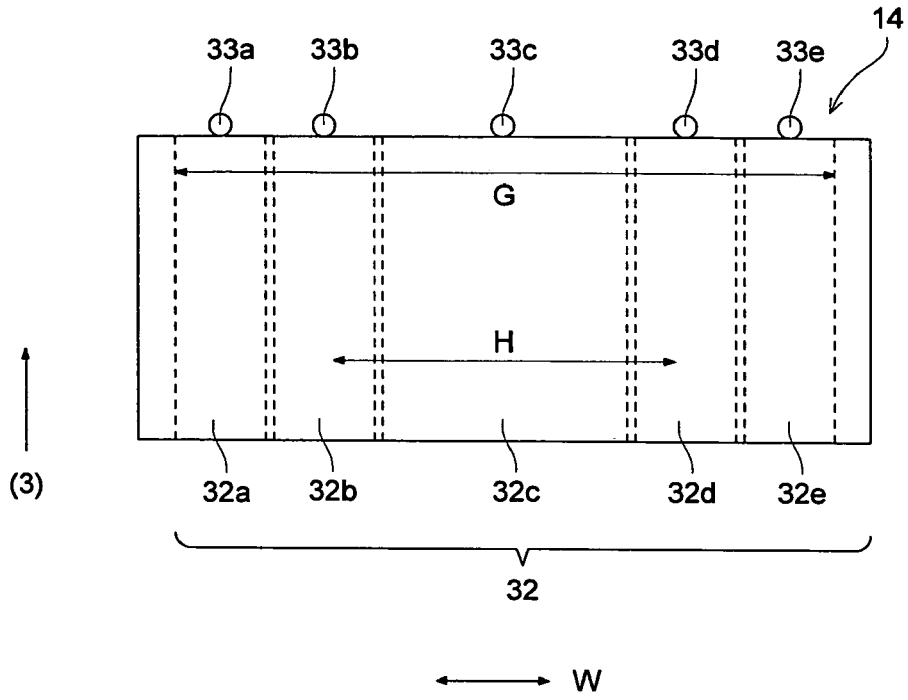
FIG. 4 is a schematic diagram showing the structure of segmented heaters viewed from the circumferential surface toward the interior of the heating drum in FIG. 3.

Heat-developing section 130 for heating film sheet F is described below, using FIGS. 1, 3 and 4. FIG. 3 is a schematic front view showing the major portions of heat-developing section 130 in FIG. 1. FIG. 4 is a schematic plan view showing the construction of the segmented heater, viewing the interior surface from the exterior circumference of the heating drum in FIG. 3.

As shown in FIGS. 1 and 3, heat developing section 130 employs heating drum 14 as a heating member which heats film sheet F while it is adhered to the drum. By keeping the temperature of film sheet F above a prescribed minimum heat development temperature for a prescribed heat development time, heating drum 14 functions to visualize the latent image on film sheet F. Here, the minimum heat development temperature is the minimum temperature, for example 95° C. in which a latent image formed on film sheet F starts to develop. On the other hand, heat development time is the duration during which the temperature of film sheet F is maintained above the minimum heat development temperature to obtain desired development characteristics of the latent image on film sheet F. It is preferable that film sheet F can not be heat-developed substantially below 40° C.

As also shown in FIGS. 1 and 3, around the exterior of heating drum 14, a plurality of rotatable opposed rollers 16 (auxiliary means), with a smaller diameter compared to heating drum 14, are installed, as guiding members and pressing members, and face the circumferential surface of heating drum 14 and further opposed rollers 16 are arranged parallel to the axis of heating drum 14.

As shown in FIGS. 1 and 3, heating drum 14 is equipped with cylindrical aluminum sleeve 36 and heater 32 as a heat source adhered on the interior surface of sleeve 36. Further, on the outer surface of heating drum 14, an elastic layer and a smooth surface layer are formed. By controlling electrical current supplied to heater 32, heating drum 14 is heated to a prescribed temperature.

Motive force of micro step motor 155 (FIG. 5) is transmitted to shaft 22 to rotate heating drum 14, whereby the film sheet is pinched between the circumferential surface of heating drum 14 and opposed rollers 16 and transported while being heated in direction (3) in FIG. 1 while opposed rollers 16 press film sheet F against heating drum 14.

Heater 32 formed as a segmented heater pattern on the inner surface of heating drum 14 as shown in FIG. 4, is composed of segmented heaters 32*a*, 32*b*, 32*c*, 32*d* and 32*e*, which are arranged by dividing the surface into 5 sections in width direction W perpendicular to the film conveyance direction (3) which is the circumferential direction of the drum. Central segmented heater 32*c* is the widest in width direction W and is structured so that segmented heaters 32*b* and 32*d* adjacent to segmented heater 32*c* are wider than segmented heaters 32*a* and 32*e* at both ends of the drum.

Thermal sensors 33*a*, 33*b*, 33*c*, 33*d* and 33*e* are located on the circumferential surface of heating drum 14 corresponding to each of segmented heaters 32*a*-32*e* as shown in FIG. 4. These sensors detect the temperature of each drum area corresponding to each of segmented heaters 32*a*-32*e* for independent temperature control of each of segmented heaters 32*a*-32*e* based on respective detected temperatures. Thermal sensors 33*a*-33*e* are structured of common thermocouples or temperature thermistors, or the like.

Segmented heaters 32*a*-32*e* heat the widest drum area G in width direction W in FIG. 4, and drum area G corresponds to 17 inches of, for example, a 14×17" size sheet. On the other hand, segmented heaters 32*b*, 32*c* and 32*d* heat drum area H, which is narrower than drum area G in width direction W, and drum area H corresponds to 10 inches of an 8×10" size sheet. For example, when drum area H is heated for development of an 8×10" size sheet, segmented heaters 32*b* and 32*d* are controlled to a lower temperature than that of drum area G corresponding to a 14×17" size sheet. Further, both outer segmented heaters 32*a* and 32*e* are not energized or controlled to a lower temperature than segmented heaters 32*b* and 32*d*. As mentioned above, by controlling individually energizing of a plurality of segmented heaters 32*a*-32*e* corresponding to the film passage phase such as drum areas G or H, it becomes possible to control temperature distribution on heating drum 14 in the width direction to become uniform in a relatively short time.

Further, light transmission type photosensor 159 is installed to detect the leading edge and subsequently the trailing edge of the film sheet upstream of paired conveying rollers 143 located at the most downstream point of the conveying means to feed the film sheet to heating drum 14 and it detects the leading edge and subsequently the trailing edge of the film sheet fed in film conveyance direction (3). This detection enables motor 151 (FIG. 5) to control driving the upstream side conveying system, including paired conveying rollers 143.

Next, the control system of the heat developing apparatus in FIG. 1 will be explained referring to FIG. 5, which is a block diagram showing the controlling system of the heat developing apparatus in FIG. 1.

Controller 152 is composed of a central processing unit (CPU) and conducts the total control of the apparatus. As shown in FIG. 5, controller 152 controls electrical current supplied to segmented heaters so as to maintain the temperature of each drum area via each respective heater to a set temperature, based on the temperatures detected by thermal sensors 33*a*-33*e*. Controller 152 further controls conveying section 5 and paired conveying rollers 139 to convey a film sheet of the corresponding size from loading section 11 or 12, based on the film size information, included in supplementary information of image data transferred from exterior image signal output device 121, shown in FIGS. 2 and 5, to heat developing apparatus 100.

Controller 152 judges that the film sheet size has been changed, based on the film size information attached to the received image data. In the case of a change of film sheet size, when photosensor 159 detects the leading edge of film sheet F2, as shown in FIG. 3, controller 152 stops motor 151 and controls following film sheet F2 to stand by while pinched between paired conveying rollers 143 for example, until the foregoing film sheet F1 is detached from heating drum 14.

Based on the rotation speed of heating drum 14 driven by micro step motor 155 and the diameter of heating drum 14, stand-by time T, until the trailing edge of the foregoing film sheet F1 is detached from heating drum 14, is calculated, and so controlled that after stand-by time T has elapsed after the conveyance starting time of the trailing edge of foregoing film sheet F1 on heating drum 14, controller 152 controls conveyance of following film sheet F2 to heating drum 14 by paired conveying rollers 143, as well as conducting temperature control of segmented heaters 32*a*-32*e* corresponding to the film sheet size.

Stand-by time T can be theoretically determined by an equation T=L/V, where the circumferential length of heating drum 14 is L (shown in FIG. 3) and the conveying speed is V, regardless of heat development temperature setting, the type of the film, whether or not there has been a size change after continuous processing or a change of size pattern. Practically, it is preferable to be T+α in consideration of inherent differences among the apparatuses such as the conveying speed or the diameter of the drum.

Next, the operation of heat developing apparatus 100 in FIGS. 1-5 will be explained referring to the flowchart of FIG. 6.

Initially, when image data, outputted from an exterior image signal output device 121 shown in FIGS. 2 and 5, are inputted into heat developing apparatus 100 (S01), a sheet of film of the size corresponding to the film size information included in the supplementary information of the image data, is conveyed from loading section 11 or 12 by conveying section 5 and paired conveying rollers 139, 140, 141 and 142 (S02), and the film sheet is exposed to form a latent image based on image signals S of the image data (S03).

Next, as well as the sheet of film on which a latent image has been formed is conveyed by paired rollers 146, 145 and 144 (S04), whether the film sheet size has been changed or not is judged compared to previously developed film sheet F1 as shown in FIG. 3, based on the film size information included in the supplementary information of the image data (S05). If the film sheet size has been changed, as shown in FIG. 3, when photosensor 159 detects the leading edge of following film sheet F2 which has been conveyed near paired conveying rollers 143 (S04), motor 151 is stopped to stop film conveyance while pinching the leading edge of film sheet F2 between paired conveying rollers 143 and controlled to stand by in this state (S07).

Next, the conveyance starting time of the trailing edge of foregoing film sheet F1 on heating drum 14 is determined based on the time when photosensor 159 detects the trailing edge of foregoing film sheet F1, and whether or not the foregoing film sheet has been detached from heating drum 14 is judged based on whether or not the stand-by time has elapsed since the starting time (S08). If stand-by time T has elapsed, temperature control of each heater 32*a*-32*e* is conducted to correspond to the size of following film sheet F2 (S09), after which following film sheet F2 is conveyed to heating drum 14 by paired conveying rollers 143 (S10).

The following film sheet F2 is conveyed while heated in heat developing section 130 to visualize the latent image by heat development (S11) and is further conveyed while cooled in cooling and conveyance section 150 (S12) and discharged to discharge section 160 (S13).

As mentioned above, according to heat developing apparatus 100 in FIGS. 1-6, when a different sized sheet of film F2 is conveyed due to a change of film sheet size after foregoing film sheet F1 of a prescribed size is heated by segmented heaters 32*a*-32*e*, so as to prevent two sequential sheets of film F1 and F2 from being simultaneously in contact with each of segmented heaters 32*a*-32*e*, after the foregoing film sheet has been detached from heat drum 14, following film sheet F2 is conveyed to the heating drum for heat development as well as temperature control via segmented heaters 32*a*-32*e* is conducted to suit the size of the following sheet of film. Therefore, in the case of a change of film sheet size, the prescribed heat can be provided to each following different sized sheet of film to obtain uniform density of the finished film sheet.

Figure 9:
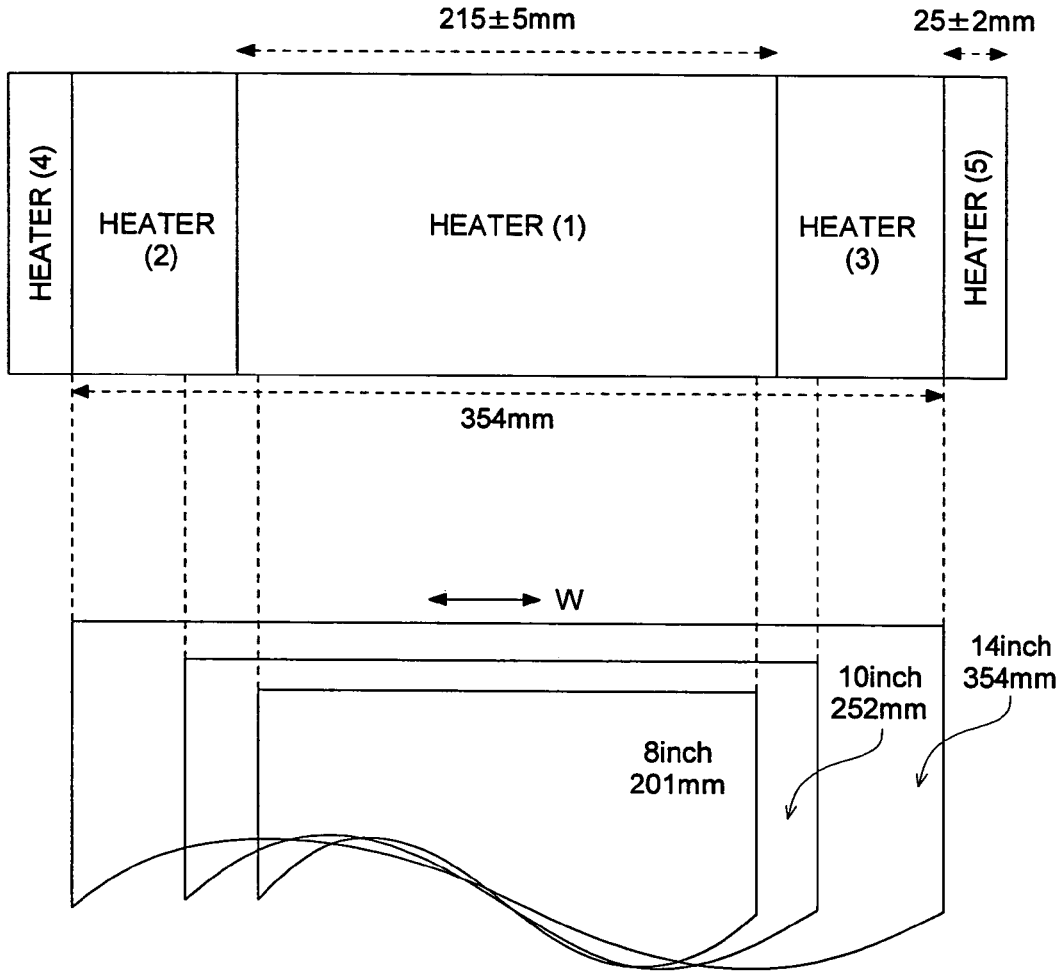
FIG. 9 is a view showing a detailed example of the segmented heaters in FIG. 4.

A detailed example of the segmented heaters illustrated in FIG. 4 is also shown in FIG. 9 and the detailed example of segmented heaters in FIG. 9 are arranged by dividing the drum surface into five sections in width direction W. The width of middle heater (1) is 215±5 mm, the width including middle heater (1) and both adjacent heaters (2) and (3) is 354 mm, and each width of heaters at both ends (4) and (5) is 25±2 mm. A 14 inch width (354 mm) film sheet such as a 14×17" size film sheet is positioned to correspond to the total width of heaters (1), (2) and (3), and a 10 inch width (252 mm) film sheet such as a 10×12" size film sheet is positioned to correspond to the width including the total width of heater (1) and partial width of heaters (2) and (3), and further an 8 inch (201 mm) size film sheet such as an 8×10" size film sheet is positioned to correspond to the width of heater (1). The relationship between the position of each segmented heater and that of film sheet of each size is arranged as shown in FIG. 9, and by controlling electric current supplied to each heater (1)-(5), quick resetting of uniform temperature distribution in the width direction W corresponding to each film sheet size can be realized.

The Second Embodiment

Figure 7:
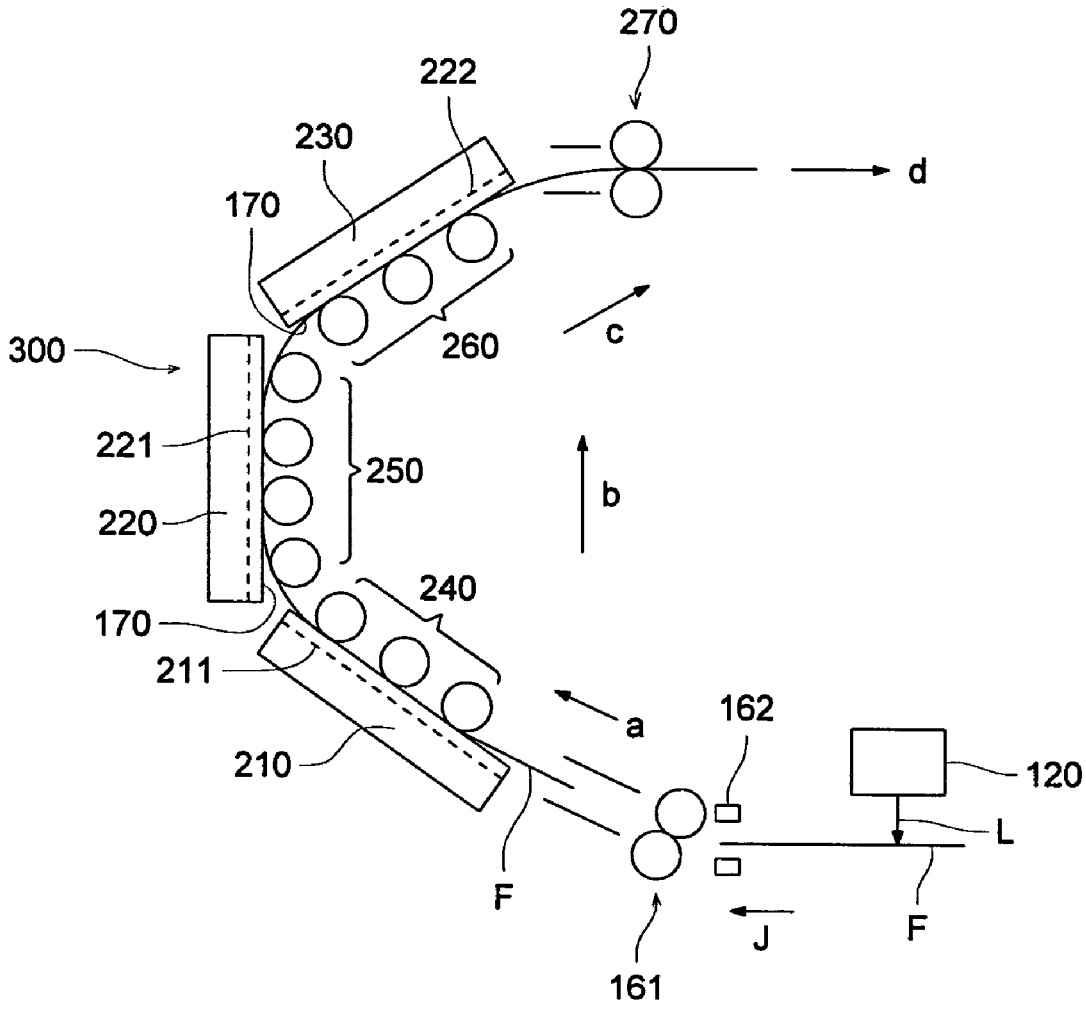
FIG. 7 is a schematic side view of the heat developing apparatus of the second embodiment.
Figure 8:
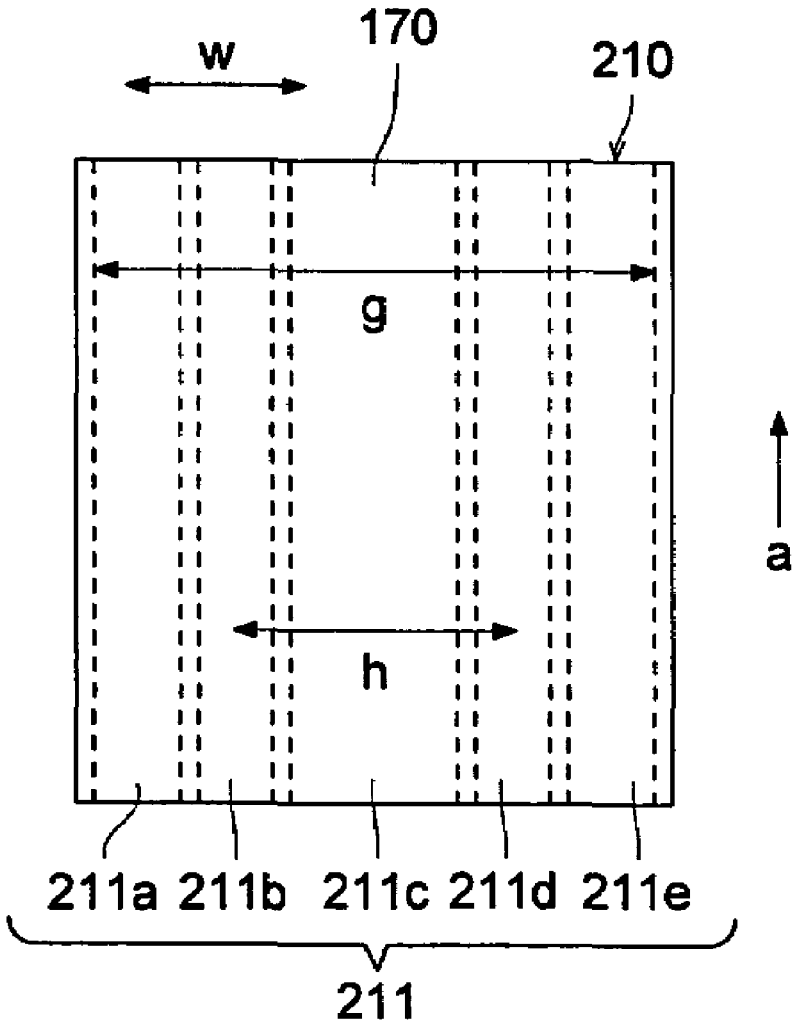
FIG. 8 is a schematic view showing the structure of the segmented heaters viewed from the front surface toward the interior of the heating section in FIG. 7.

FIG. 7 is a schematic side view of the heat developing apparatus of the second embodiment. FIG. 8 is a schematic plan view of the segmented heaters.

As shown in FIG. 7, heat developing apparatus 300 is a combination of first heating section 210, second heating section 220 and the third heating section 230. First heating section 210 is positioned obliquely to convey the film sheet obliquely upward, the second heating section 220 is positioned vertically to convey the film sheet upward and the third heating section 230 is positioned obliquely to convey the film sheet obliquely upward so that as a whole they basically form a substantial arc shape.

In heat developing apparatus 300 in FIG. 7, paired conveying rollers 161 are located upstream of first heating section 210, and further, exposure section 120, being the same as in FIG. 2 is located upstream of paired conveying rollers 161. In exposure section 120, by means of applying main scanning of laser beam L onto the sheet of film in the perpendicular direction, while sub-scanning conveyance in conveying direction J is conducted to film sheet F, a latent image is formed on film sheet F based on the image data.

Paired of conveying rollers 161 feed film sheet F, which has been conveyed in horizontal conveying direction J, into first heating section 210.

Reflective type photosensor 162 is located so as to detect the leading edge and the trailing edge of the sheet of film near the upstream side of paired conveying rollers 161. On the upstream side of exposure section 120, a prescribed sized film sheet can be fed toward exposure section 120 from plural loading sections (not illustrated) in which film sheets of different sizes are loaded the same as in the first embodiment.

First heating section 210, second heating section 220 and third heating section 230 are opposed by a plurality of auxiliary rollers 240, 250 and 260 respectively to convey film sheet F in the directions of arrows "a" (obliquely upward), "b" (vertically) and "c" (obliquely upward) consecutively as shown in FIG. 7. Further each heating section 210, 220 and 230 has guide surface 170, which has a straight or curved surface in the conveyance direction and a concave surface in the direction perpendicular to the conveyance direction and internal sheet-shaped heaters 211, 212 and 213.

Heater 211 of heating section 210 has a segmented heater pattern as shown in FIG. 8 and is structured of segmented heaters 211*a*, 211*b*, 211*c*, 211*d* and 211*e* which are arranged by dividing the surface into 5 sections in width direction "w" perpendicular to film conveyance direction "a". Middle segmented heater 211*c* is the widest in width direction "w", and segmented heaters 211*b* and 211*d* adjacent to segmented heater 211*c* are wider than segmented heaters 211*a* and 211*e* on both ends of heater 211.

A thermal sensor is located to correspond to each of segmented heaters 211*a*-211*e* of heating section 210, whereby temperature of the heating area corresponding to each segmented heater is detected, and the temperature of each segmented heater 211*a*-211*e* can be independently controlled based on these detected temperatures.

Segmented heaters 211*a*-211*e* heat the widest heating area "g" in width direction "w" so that the heating area "g" corresponds to 17 inches of for example a 14×17" sized sheet of film. On the other hand, segmented heaters 211*b*, 211*c* and 211*d* heat heating area "h", which is narrower than heating area "g" in width direction "w" and corresponds to 10 inches of an 8×10" size sheet. For example, when heating area "h" is heated for development of an 8×10" size sheet, segmented heaters 211*b* and 211*d* are controlled to have lower temperature than in the case of heating area "g" corresponding to a 14×17" size sheet, and therefore, both outer segmented heaters 211*a* and 211*e* are not energized or are controlled to have a lower temperature than segmented heaters 211*b* and 211*d*. As mentioned above, by individually energizing to a plurality of segmented heaters 211*a*-211*e* corresponding to film passage phase such as heating areas "g" or "h", it becomes possible to control temperature distribution in heating section 210 across the width to become uniform in a relatively short time.

Second heating section 220 and third heating section 230 are structured the same as first heating section 210, and each of the heaters is also controlled individually, and further, first, second and third heating sections 210, 220 and 230 also have their temperatures independently controlled.

Each set of auxiliary rollers 240, 250 and 260 is driven by a motor (not illustrated) to convey film sheet F in the conveyance directions "a", "b" and "c" while pressing film sheet F against each heating section 210, 220 and 230. Film sheet F sent from third heating section 230 is fed in horizontal direction "d" and is discharged by paired conveying rollers 270.

Figure 6:
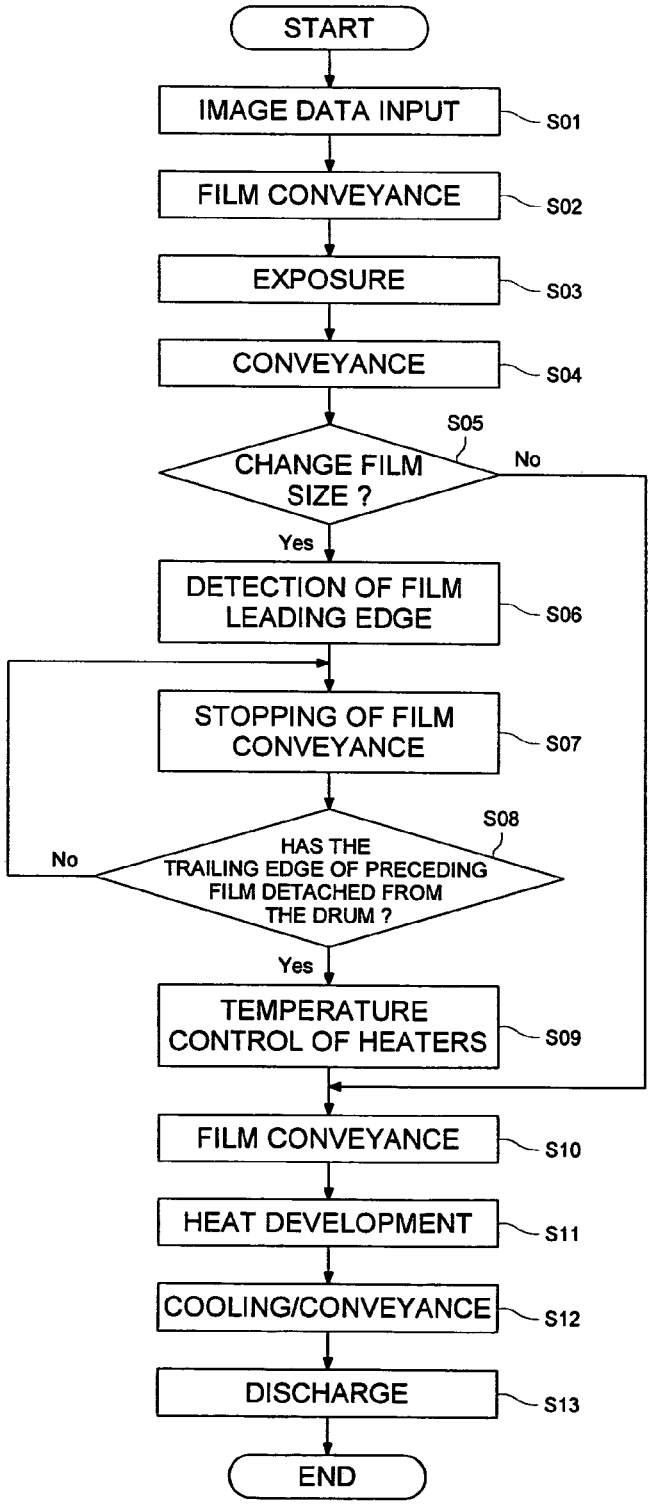
FIG. 6 is a flowchart explaining the operation of heat developing apparatus 100 in FIGS. 1-5.

Heat developing apparatus 300 in FIG. 7 is controlled by a controlling system similar to the one in FIG. 5 and is operated basically the same as shown in FIG. 6. First, image data are inputted into heat developing apparatus 300 from an exterior apparatus, and a sheet of film, of the size corresponding to the film size information included in the supplementary information of the image data, is conveyed from a loading section and exposed to form-a latent image based on image signals S of the image data in exposure section 120.

Next, as the sheet of film, on which a latent image has been formed, is conveyed, whether the film sheet size has been changed or not is judged compared to the previously developed sheet of film based on the film size information included in the supplementary information of the image data. If the film sheet size has been changed, when photosensor 162 detects the leading edge of film sheet F2 which has been carried to near paired conveying rollers 161, as shown in FIG. 7, motor 151 is stopped to stop film conveyance while pinching the leading edge of the film sheet between the paired conveying rollers 161 and is controlled to stand by in this state.

Next, the conveyance starting time of the trailing edge of the foregoing film sheet in heating section is obtained based on the time when photosensor 162 detects the trailing edge of the foregoing film sheet, and whether or not the foregoing film sheet has been detached from first heating section 210 is judged based on whether or not the stand-by time has elapsed since the starting time. If stand-by time T has elapsed, temperature control of each heater 211*a*-211*e* of first heating section 210 is conducted to suit the size of the following film sheet and the following film sheet is conveyed to first heating section 210 by paired conveying rollers 161.

Similarly, after the trailing edge of the foregoing film sheet has passed second heating section 220, temperature control of second heating section 220 is conducted to suit the size of the following film sheet and the following film sheet is conveyed there, and subsequently to third heating section 230 after the trailing edge of the foregoing film sheet has passed there, where temperature control of the same manner as in the previous heating sections is conducted. After having been heated for heat development, the film sheet is then discharged by paired conveying rollers 270 in horizontal direction "d".

Stand-by time T mentioned above, can be determined from film conveying speed of auxiliary rollers 240 and the length of heating section 210 in conveyance direction "a". The film sheet is conveyed at the same speed also in heating sections 220 and 230. The length of each heating section 210, 220 and 230 in each conveyance direction "a"-"c" is identical. Accordingly, by conveying the following film sheet after the above stand-by time T has elapsed, there is no possibility for two sequential film sheets to be simultaneously in contact with each of three heating section 210, 220 and 230.

In the case of the second embodiment, it is preferable to set extra time a to be a little longer in consideration of inherent differences among length of each heater L1, L2 and L3 in the film sheet conveyance path. Further, in the case that the length L1, L2 and L3 are obviously different, stand-by time T needs to be determined by the longest length of the three.

As mentioned above, according to heat developing apparatus 300 in FIGS. 7 and 8, when a different sized film sheet is conveyed due to a change of sheet size after the foregoing film sheet of a prescribed size is heated by segmented heaters 211*a*-211*e* of first heating section 210, so as to prevent two sequential film sheets from being simultaneously in contact with segmented heaters 211*a*-211*e*, after the foregoing film sheet has been detached from first heating section 210, the following film sheet is conveyed into first heating section 210 for heating as well as temperature control, via segmented heaters 211*a*-211*e* to suit the size of the following film sheet. The following film sheet is fed into second heating section 220, and further third heating section 230 for heating at similar intervals avoiding being heated together with the foregoing film sheet in the same heating section and temperature control of the segmented heaters of each heating section can be conducted. Therefore, in the case of a change of film sheet size, prescribed heat capacity can be provided to the following different sized film sheet to obtain uniform image density of the finished film sheet.

The best practical embodiments are explained above, however the invention is not limited to these and the embodiments can be modified within the range of the technical theory of this invention. For example, the number of the film loading sections is two in FIG. 1, but could also be three or more. Also, three or more loading sections can be similarly installed in FIG. 7. In FIGS. 3 and 7, although light-transmission type photosensors 159 and 162 are employed, light-reflective type photosensors can be employed.

Further, in FIGS. 3 and 7, to prevent sequential sheet of film of different sizes from existing in the same heating section at the same time, the conveyance interval is controlled by the stand-by time, however this invention is not limited to this, for example, by employing a photosensor near the exit of film sheet from heating drum 14 in FIG. 3 (a photosensor is located between heating sections 210 and 220 in FIG. 7), the photosensor can detect that the trailing edge of the film sheet is detached from heating drum 14 or heating section 210.

What is claimed is:

1. A heat developing apparatus comprising:

a film loading device in which heat-developing photosensitive film sheets of a plurality of different sizes are loaded, a conveying device to convey each of the heat-developing photosensitive film sheets sequentially in a conveyance direction from the film loading device, an exposing device to form a latent image on the conveyed heat-developing photosensitive film sheet, a heat-developing device to develop the heat-developing photosensitive film sheet on which the latent image has been formed for visualizing the latent image, further comprising a heating device structured of a plurality of heater segments divided in the conveyance direction of the heat-developing photosensitive film sheet, each of which is independently temperature controllable, and a controlling device to control the conveying device, the exposing device and the heat-developing device, wherein the controlling device controls the conveying device to convey the heat-developing photosensitive film sheets so that any one of the plurality of heater segments is not simultaneously in contact with heat-developing photosensitive film sheets of different sizes.

2. The heat developing apparatus described in claim 1, wherein when heat-developing photosensitive film sheets of different sizes are conveyed, until a trailing edge of a foregoing heat-developing photosensitive film sheet has been detached from any one of the heater segments of the heating device, the controlling device temporally stops a conveyance of a following heat-developing photosensitive film sheet of a different size to the any one of the heater segments of the heating device.

3. The heat developing apparatus described in claim 1, wherein the heat developing device comprises a heating drum which is equipped with a sheet heater on an interior of a sleeve of the heating drum and is driven to rotate and also is equipped with opposed rollers which are installed opposite to a circumference of the heating drum.

4. The heat developing apparatus described in claim 1, further comprising:

an auxiliary device to convey the heat-developing photosensitive film sheet while pressing the heat-developing photosensitive film sheet against the heating device, wherein the heating device divided into a plurality of heater segments comprises fixed plate heaters and the auxiliary device comprises opposed rollers installed opposite to the plate heaters.

5. The heat developing apparatus described in claim 1, wherein the heating device is structured of a plurality of heater segments divided in the conveyance direction and in a direction perpendicular to the conveyance direction, each of which is independently temperature controllable.

6. A heat developing method comprising the steps of:

forming a latent image on a heat-developing photosensitive film sheet, heating and developing the heat-developing photosensitive film sheet on which the latent image has been formed while conveying the heat-developing photosensitive film sheet in a conveyance direction, by a heater which is divided into a plurality of heater segments in the conveyance direction, each of which is independently temperature controllable, and conveying the heat-developing photosensitive film sheets such that heat-developing photosensitive film sheets of different sizes are not simultaneously in contact with any one of the plurality of heater segments.

7. The heat developing method described in claim 6, wherein, when heat-developing photosensitive film sheets of different sizes are conveyed, until a trailing edge of a foregoing heat-developing photosensitive film sheet has been detached from any one of the heater segments, a conveyance of a following heat-developing photosensitive film sheet of a different size to the any one of the heater segments is temporally stopped.

8. The heat developing method described in claim 6, wherein the heating and developing step is conducted by a heater which is divided into a plurality of heater segments in the conveyance direction and in a direction perpendicular to the conveyance direction, each of which is independently temperature controllable.

9. A heat developing apparatus comprising:

a film loading device in which heat-developing photosensitive film sheets of a plurality of different sizes are loaded, a conveying device to convey each of the heat-developing photosensitive film sheets sequentially in a conveyance direction from the film loading device, an exposing device to form a latent image on the conveyed heat-developing photosensitive film sheet, a heat-developing device to develop the heat-developing photosensitive film sheet on which the latent image has been formed for visualizing the latent image, further comprising a heating device structured of a plurality of heater segments divided in the conveyance direction and in a direction perpendicular to the conveyance direction of the heat-developing photosensitive film sheet, each of which is independently temperature controllable, and a controlling device to control the conveying device, the exposing device and the heat-developing device, wherein the controlling device controls the conveying device to convey the heat-developing photosensitive film sheets so that any one of the plurality of heater segments is not simultaneously in contact with heat-developing photosensitive film sheets of different sizes.

10. The heat developing apparatus described in claim 9, wherein when heat-developing photosensitive film sheets of different sizes are conveyed, until a trailing edge of a foregoing heat-developing photosensitive film sheet has been detached from any one of the heater segments of the heating device, the controlling device temporarily stops a conveyance of a following heat-developing photosensitive film sheet of a different size to the any one of the heater segments of the heating device.

11. The heat developing apparatus described in claim 9, wherein the heat developing device comprises a heating drum which is equipped with a sheet heater on an interior of a sleeve of the heating drum and is driven to rotate and also is equipped with opposed rollers which are installed opposite to a circumference of the heating drum.

12. The heat developing apparatus described in claim 9, further comprising:

an auxiliary device to convey the heat-developing photosensitive film sheet while pressing the heat-developing photosensitive film sheet against the heating device, wherein the heating device divided into a plurality of heater segments comprises fixed plate heaters and the auxiliary device comprises opposed rollers installed opposite to the plate heaters.

13. A heat developing method comprising the steps of:

forming a latent image on a heat-developing photosensitive film sheet, heating and developing the heat-developing photosensitive film sheet on which the latent image has been formed while conveying the heat-developing photosensitive film sheet in a conveyance direction, by a heater which is divided into a plurality of heater segments in the conveyance direction and in a direction perpendicular to the conveyance direction, each of which is independently temperature controllable, and conveying the heat-developing photosensitive film sheets such that heat-developing photosensitive film sheets of different sizes are not simultaneously in contact with any one of the plurality of heater segments.

14. The heat developing method described in claim 13, wherein when heat-developing photosensitive film sheets of different sizes are conveyed, until a trailing edge of a foregoing heat-developing photosensitive film sheet has been detached from any one of the heater segments, a conveyance of a following heat-developing photosensitive film sheet of a different size to the any one of the heater segments is temporarily stopped.

* * * * *